US007225862B2

(12) United States Patent
Chin et al.

(10) Patent No.: US 7,225,862 B2
(45) Date of Patent: Jun. 5, 2007

(54) HIGH-PERFORMANCE HEAT EXCHANGER

(75) Inventors: Sim Won Chin, Gwangmyeong-si (KR); Dong Su Moon, Seoul (KR)

(73) Assignee: LG Electronics Inc., Seoul (KR)

( * ) Notice: Subject to any disclaimer, the term of this patent is extended or adjusted under 35 U.S.C. 154(b) by 162 days.

(21) Appl. No.: 10/914,085

(22) Filed: Aug. 10, 2004

(65) Prior Publication Data

US 2005/0241811 A1 Nov. 3, 2005

(30) Foreign Application Priority Data

Apr. 29, 2004 (KR) ..... 10-2004-0030032

(51) Int. Cl.
*F24H 3/08* (2006.01)
*F25D 17/06* (2006.01)

(52) U.S. Cl. ..... 165/133; 165/122; 165/125; 62/418

(58) Field of Classification Search ..... 165/122, 165/124, 125, 133; 62/418, 419, 426, 908
See application file for complete search history.

(56) References Cited

U.S. PATENT DOCUMENTS 3,050,959 A 8/1962 Rich
3,973,718 A 8/1976 Deschamps
4,199,937 A 4/1980 Fortini et al.
5,145,001 A * 9/1992 Valenzuela ..... 165/164
5,211,219 A * 5/1993 Kawabata et al. ..... 165/122
5,575,326 A * 11/1996 Asami et al. ..... 165/124
6,050,101 A 4/2000 Liu
6,142,222 A * 11/2000 Kang et al. ..... 165/148

FOREIGN PATENT DOCUMENTS

GB 1147027 4/1969
KR 10-225635 10/1999
KR 2001-0076991 8/2001
WO WO 95/23951 * 9/1995

* cited by examiner

*Primary Examiner*—Teresa J. Walberg
(74) *Attorney, Agent, or Firm*—Greenblum & Bernstein, P.L.C.

(57) ABSTRACT

Provided is a high-performance heat exchanger. A porous material is formed on one side of the heat exchanger. The porous material exchanges heat with a coolant pipe and/or a fin. Pores formed in the porous material improve exchanging heat with the air, thereby improving a heat exchanging performance of the heat exchanger.

17 Claims, 6 Drawing Sheets

HIGH-PERFORMANCE HEAT EXCHANGER

BACKGROUND OF THE INVENTION

1. Field of the Invention

The present invention relates to a heat exchanger, and more particularly to a high-performance heat exchanger that enables more intensive use of an installation space for the heat exchanger by improving the performance of the heat exchanger. Also, the present invention relates to a high-performance heat exchanger, which is capable of improving an air-cleaning ability by allowing a filter to be installed over a wider area in the heat exchanger.

2. Description of the Related Art

Generally, an air conditioning system or refrigeration system performs a series of cycles, each having compression, condensation, expansion and evaporation of a coolant. In particular, the condensation and evaporation require tools where the coolant emits or absorbs heat together with phase change. Such tools have many coolant pipes and fins, and allows emission or absorption of heat by means of forcible air channel formed around them. In addition, a heat exchanger is applied for absorbing heat from, or emitting heat to, the coolant which circulates in the system. For the heat exchanger, it is most important how much heat may be rapidly exchanged and how narrow space is needed for it.

For improving the performance of such a heat exchanger, researches are conventionally focused on the arrangement of fins and coolant pipes, which may improve degree of contact between the coolant pipes and the fins in the heat exchanger and may not hinder the forcible air channel.

However, the conventional researches showed a limit in improving performance of the heat exchanger, so there is an urgent need for a new structure that can improve the heat-exchanging performance.

SUMMARY OF THE INVENTION

Accordingly, the present invention is directed to a high-performance heat exchanger that substantially obviates one or more problems due to limitations and disadvantages of the related art.

An object of the present invention is to provide a new method for improving performance of such a heat exchanger. In particular, the present invention proposes a heat exchanger that can overcome a limitation of space, and improve the heat-exchanging performance by being installed simply even in a narrow space.

In addition, the present invention proposes a high-performance heat exchanger, which allows an overall air conditioner to have a smaller size, thereby being more suitable for customer's taste.

In addition, the present invention proposes a high-performance heat exchanger, which is capable of satisfying the need of customers by adding an air-cleaning function with a simple additional configuration, and also improving the performance of the air conditioner itself.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a high-performance heat exchanger, which includes: a heat exchanger for exchanging heat; a fan for forcibly blowing air to the heat exchanger; and a porous material formed on one side of the heat exchanger in order to improve a heat-exchanging performance.

In another aspect of the present invention, there is also provided a high-performance heat exchanger, which includes a heat exchanger having coolant pipes and fins for exchanging heat; a fan for forcibly blowing air to the heat exchanger; a cartridge fixed to the heat exchanger; an air-cleaning means received in the cartridge; and a porous material inserted into a space between the air-cleaning means and the heat exchanger in order to improve a heat-exchanging performance.

In still another aspect of the present invention, there is also provided a high-performance heat exchanger, which includes a heat exchanger having coolant pipes for flowing air therethrough and fins contacted with the coolant pipes; and a porous material formed on one side of the heat exchanger in order to exchange heat with the coolant pipes and/or the fins, thereby increasing a size exposed to the air and thus improving a heat-exchanging performance.

By using the suggested configuration, it is possible to give a smaller heat exchanger which may satisfy customer's taste, and the indoor circumstance may be kept more agreeable and comfortable.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Hereinafter, specific embodiments of the present invention will be described in detail with reference to the accompanying drawings. Though the proposed embodiments are described with an indoor unit of an air conditioner as an example, it should be understood that the spirit of the invention is not limited to the indoor unit of an air conditioner.

First Embodiment

Figure 1:
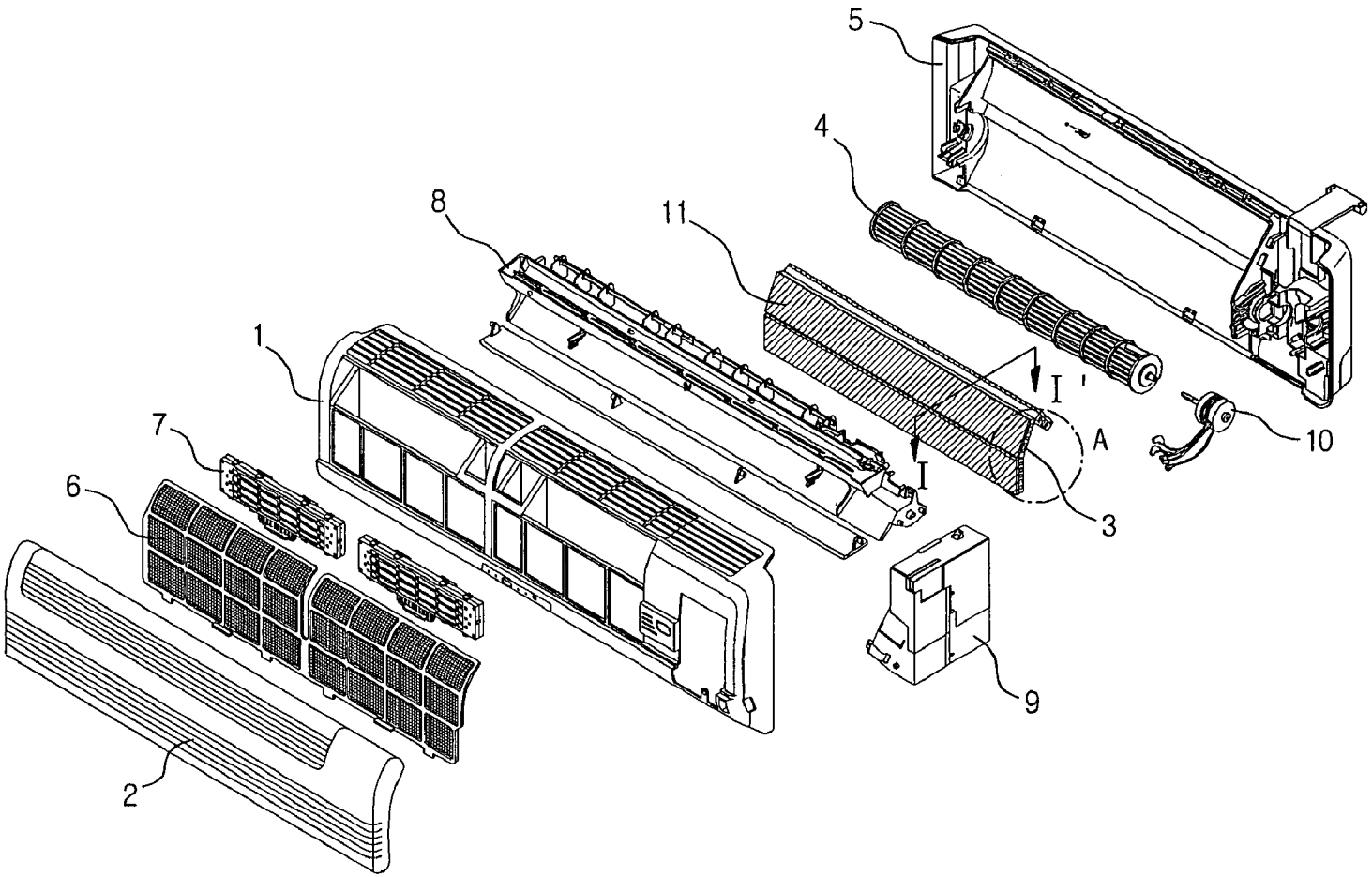
FIG. 1 is an exploded perspective view showing an indoor unit of an air conditioner to which the spirit of the present invention is applied.

FIG. 1 is an exploded perspective view showing an indoor unit of an air conditioner to which the spirit of the present invention is applied.

Referring to FIG. 1, the indoor unit of an air conditioner includes a chassis 1 forming a framework of the indoor unit, an induction grill 2 positioned at the front of the chassis 1 so that an outside air is introduced therein, a channel guide 5 positioned at the rear of the chassis 1 to form a rear wall of the indoor unit, a cross flow fan 4 positioned at the front of the channel guide 5 to make a forcible flow of air, and a motor 10 for driving the cross flow fan 4.

In addition, the indoor unit includes a heat exchanger 3 positioned at the front of the cross flow fan 4 to exchange heat, a porous material 11 attached to a front surface of the heat exchanger 3 to improve a heat-exchanging performance of the heat exchanger, and a discharge vane 8 for guiding a flow direction of the discharged air.

In addition, an air filter 6 and a dust collector 7 are provided at the front of the chassis 1 in order to filter dusts and make a more agreeable indoor circumstance. In addition, a control box 9 is put on any side of the indoor unit so as to control operation of the indoor unit.

Describing the operation of the indoor unit with reference to the aforementioned configuration, air introduced through the induction grill 2 is inhaled via the chassis 1 with filtering dusts in the air by means of the air filter 6 and the dust collector 7. The inhaled air is cooled by the heat exchanger 3, then forcibly flowed by the cross flow fan 4 and the channel guide 5, and then discharged indoors with its discharging direction controlled by the discharge vane 8. Of course, a user may manipulate the operation of the indoor unit by using the control box 9.

Among the components above, the porous material 11 is formed on the front surface of the heat exchanger 3, and improves a heat-exchanging performance. Thus, under the same conditions of the heat exchanger with the same size, the heat-exchanging performance may be further improved. Function, structure and shape of the porous material 11 will be described in detail later.

Figure 2:
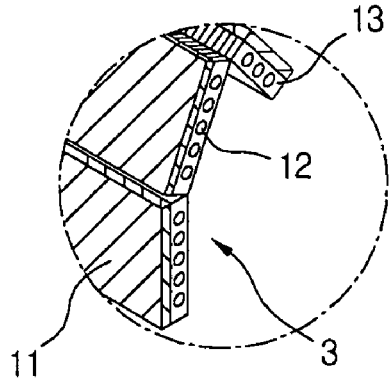
FIG. 2 is an enlarged view showing A area of FIG. 1.
Figure 3:
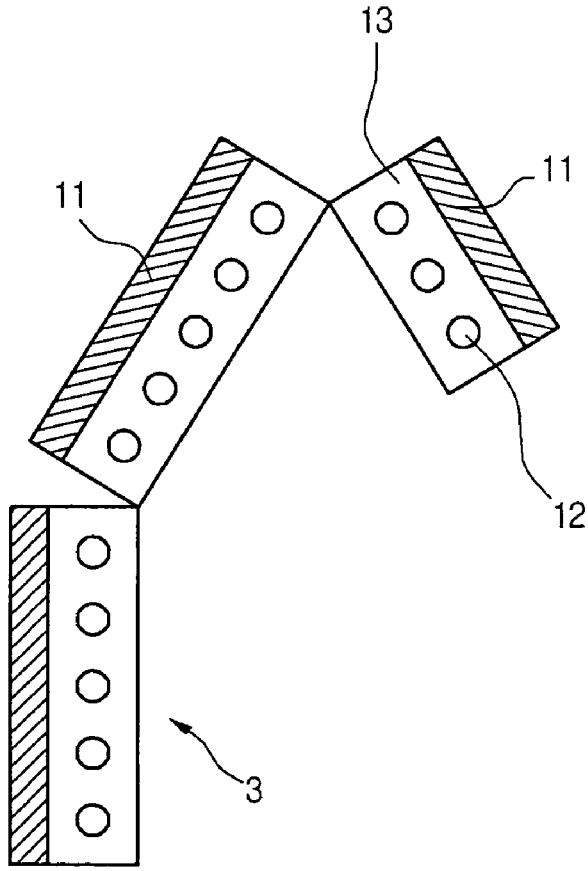
FIG. 3 is a sectional view taken along the I–I' line of FIG. 1.

FIG. 2 is an enlarged view showing A area of FIG. 1, and FIG. 3 is a sectional view taken along the I–I' line of FIG. 1.

Referring to FIGS. 2 and 3, the heat exchanger 3 includes coolant pipes 12 and fins 13 through which a coolant passes, and the porous material 11 is further formed on the front surface of the heat exchanger 3. The porous material 11 is made of metal, for example aluminum (Al), in which a plurality of pores are formed by means of a special treatment, for example foaming, and the shape of the porous material itself is kept by thin frames. In addition, a size of the pores formed in the porous material 11 is several micrometers. In a physical aspect, the porous material 11 is light and has excellent heat conductivity. Recently, a porous material made of graphite has been proposed, and it may also be used for the heat exchanger of the present invention.

By combining the suggested porous material 11 to one side of the heat exchanger 3, cold or warmth of the heat exchanger 3 may be transferred to the porous material 11. The cold or warmth transferred to the porous material 11 may exchange heat by means of air flow guided to the heat exchanger 3. Since the porous material has good heat-exchanging performance, it is apparent that the performance of the entire heat exchanger 3 is improved.

Figure 4:
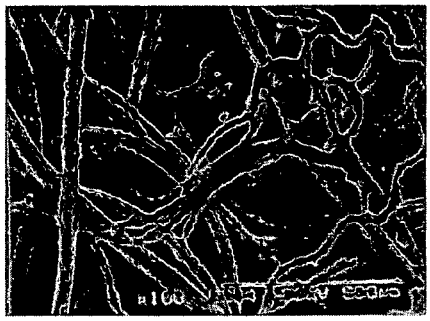
FIG. 4 is an enlarged view showing a porous material applied to the present invention.

The porous material 11 may be better described with reference to an enlarged sectional view of a porous material suggested in FIG. 4. Referring to FIG. 4, it may be seen that a plurality of pores with a size of several micrometers are formed in the porous material 11.

Figure 5:
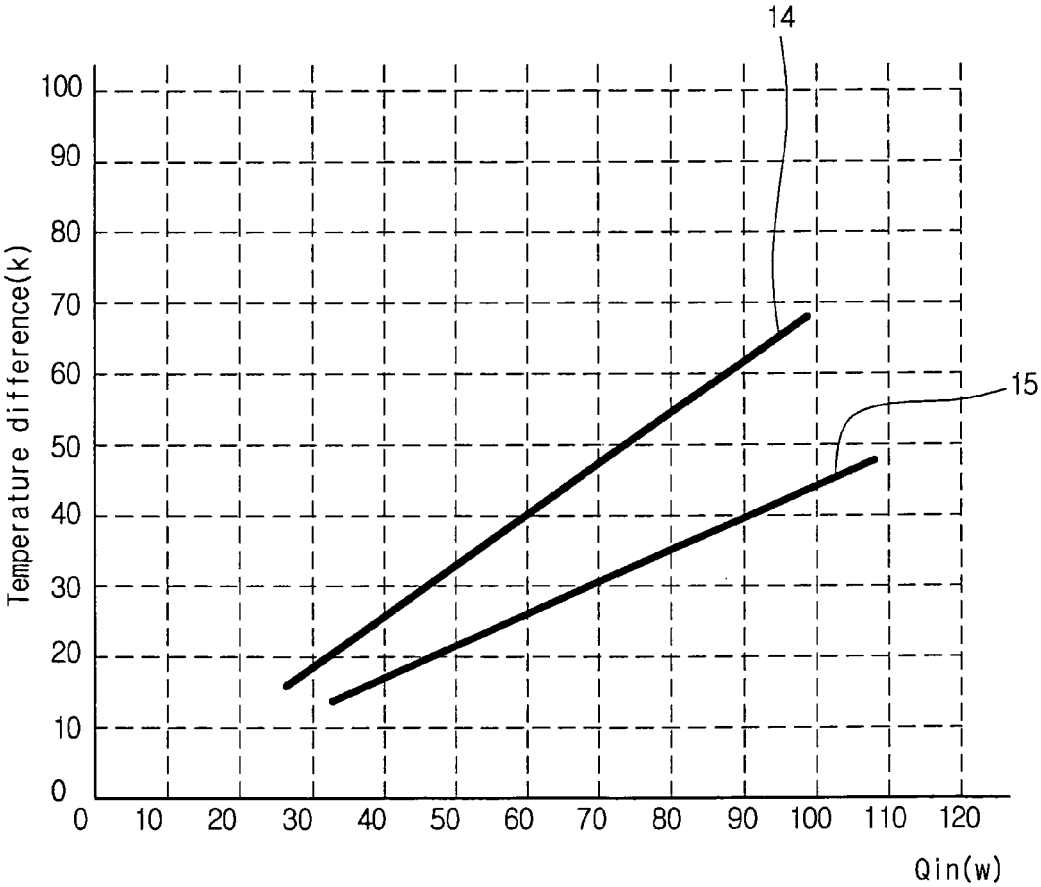
FIG. 5 is a graph for illustrating performance of a heat exchanger according to the present invention.

FIG. 5 is a graph showing experimental results in order to illustrate the performance of the heat exchanger according to the present invention. Seeing the graph, the experimental results show performances of heat exchangers which have the same size, the same number of cooling fins, and the same capacity of the cross flow fan, but one of which is provided with the porous material and the other of which is not provided with the porous material.

Referring to FIG. 5, a horizontal axis of the graph shows an exchanged heat capacity (Qin), while a vertical axis shows a difference between a temperature of the heat exchanger and a temperature of the open air. As for dimensions, the vertical axis has a dimension of watt (W), and the vertical axis has a dimension of temperature (T). Under such experimental conditions, a thermal resistance curve of a heat exchanger which is not provided with the porous material is designated by a first line 14, and an experimental result of a heat exchanger provided with the porous material is designated by a second line 15. To explain the experimental results, the first line 14 has a steeper slant than the second line 15. Comparing such lines, the different slants show that the heat exchanger corresponding to the first line has greater thermal resistance than the heat exchanger corresponding to the second line, so it is less efficient and shows lower temperature though heat is exchanged under the same conditions. More specifically, a thermal resistance in case of the first line 14 is 0.66 K/W, and a thermal resistance in case of the second line 15 is 0.47 K/W. Therefore, it is understood that the heat-exchanging performance is improved as much as about 30% when the porous material is adopted.

In addition, since a plurality of pores are formed in the porous material 11, there is substantially no resistance against the air flowing therein, so the cross flow fan 4 requires almost no additional power consumption for operation.

As a result of the aforementioned experiments, for a heat exchanger without the porous material (depicted by the first line) to obtain the same heat-exchanging performance as a heat exchanger with the porous material (depicted by the second line), other ways should be considered, for example using a large-scale cross flow fan or making a heat exchanger larger. However, it cannot help but causing drawbacks such as increase of manufacture costs or increase of energy consumption.

Meanwhile, the porous material 11 may combined to the heat exchanger 3 using the following various ways: pressing the porous material 11 toward a heat sink by using flexibility of the porous material 11; soldering or brazing the porous material 11 to a heat sink with the use of soft solder having lead and tin in order to enhance an adhesive force; and coating thermal compound or thermal conductivity grease on the front surface of the heat exchanger 3 and an interface of the porous material 11.

Meanwhile, though it is shown in the figures that the porous material 11 is combined to the front surface of the heat exchanger, it is also possible that the porous material is combined to the rear surface thereof.

Second Embodiment

The second embodiment of the present invention is substantially identical to the first invention in many aspects. However, an air-cleaning means for cleaning air is formed at a position adjacent to the heat exchanger, therefore an indoor unit of this embodiment has several advantages, namely a size of the indoor unit is further reduced and an air-cleaning ability is improved for the entire area of the flow channel. In addition, the indoor unit according to the second embodiment has another advantage that the improvement of heat-exchanging performance owing to a porous material 25 (see FIG. 8) may be kept for a long time by restraining dusts in the air from being accumulated in the porous material.

The air-cleaning means may include an air filter and a dust collector. In addition to them, the air-cleaning means may have a filtering means of any other shape.

Figure 6:
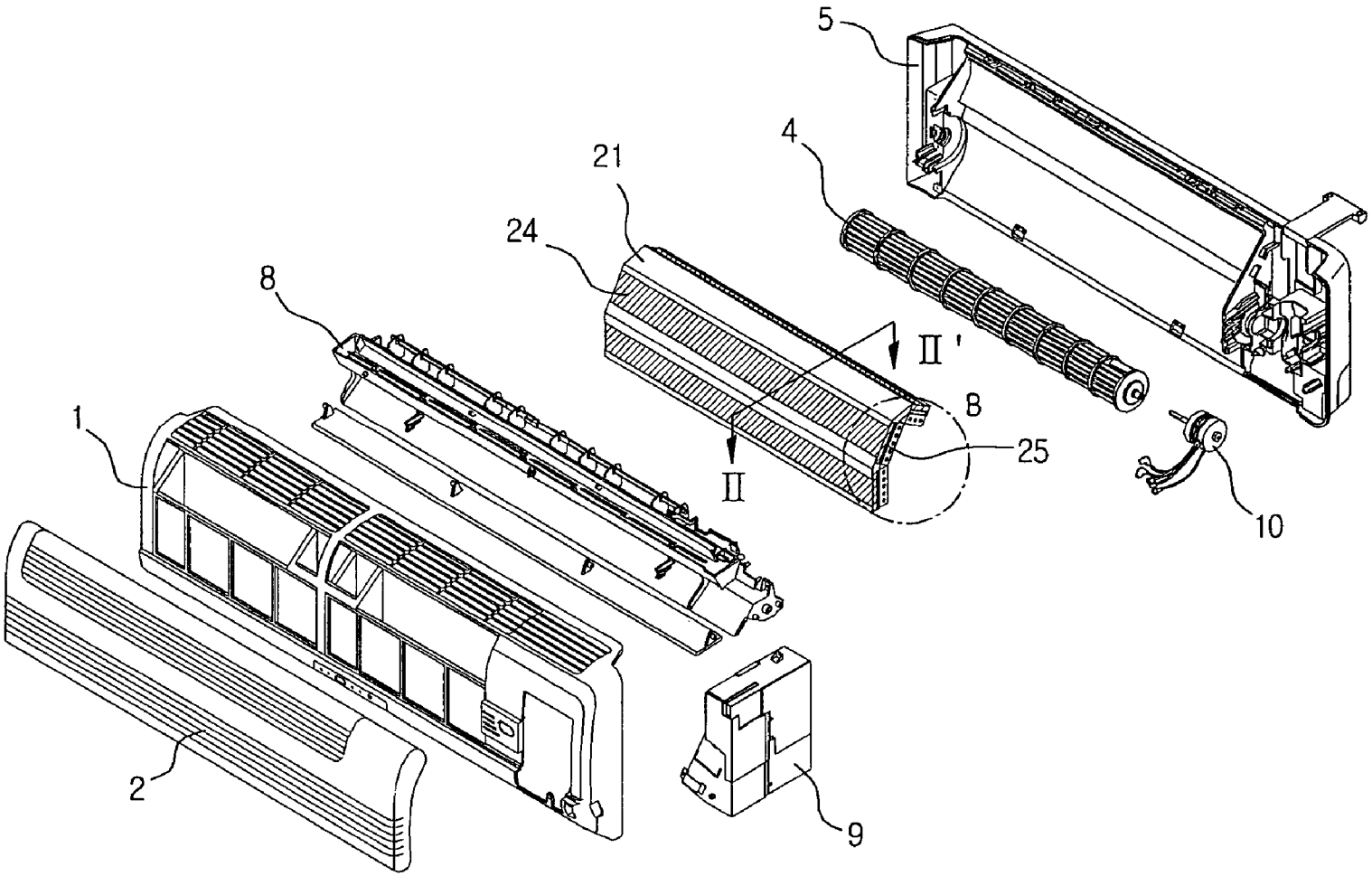
FIG. 6 is an exploded perspective view showing an air conditioner according to a second embodiment of the present invention.

FIG. 6 shows the indoor unit according to the second embodiment of the present invention. The indoor unit of this embodiment is identical to that of the first embodiment, except that the air filter and/or the dust collector is combined to the front surface of the heat exchanger, as an air-cleaning means. The same components as the first embodiment may be quoted from the former description.

As mentioned above, since dirt such as dust is filtered by the air-cleaning means formed in front of the porous material 25, dirt is not accumulated in the porous material 25, so the improvement of heat-exchanging performance caused by the porous material 25 may be kept for a long time. In addition, since the air-cleaning means is formed together with the heat exchanger 3 all together, not as a separate part mounted in front of the chassis 1, the inner space of the indoor unit may be more efficiently utilized. Moreover, since the air-cleaning means may clean the entire air introduced to the heat exchanger, an air-cleaning ability of the entire indoor unit is more improved.

Figure 7:
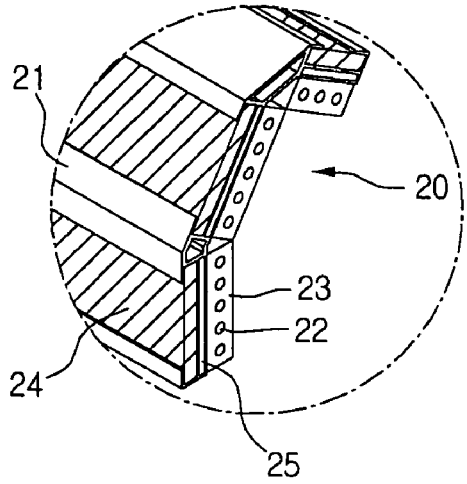
FIG. 7 is an enlarged view showing B area of FIG. 6.
Figure 8:
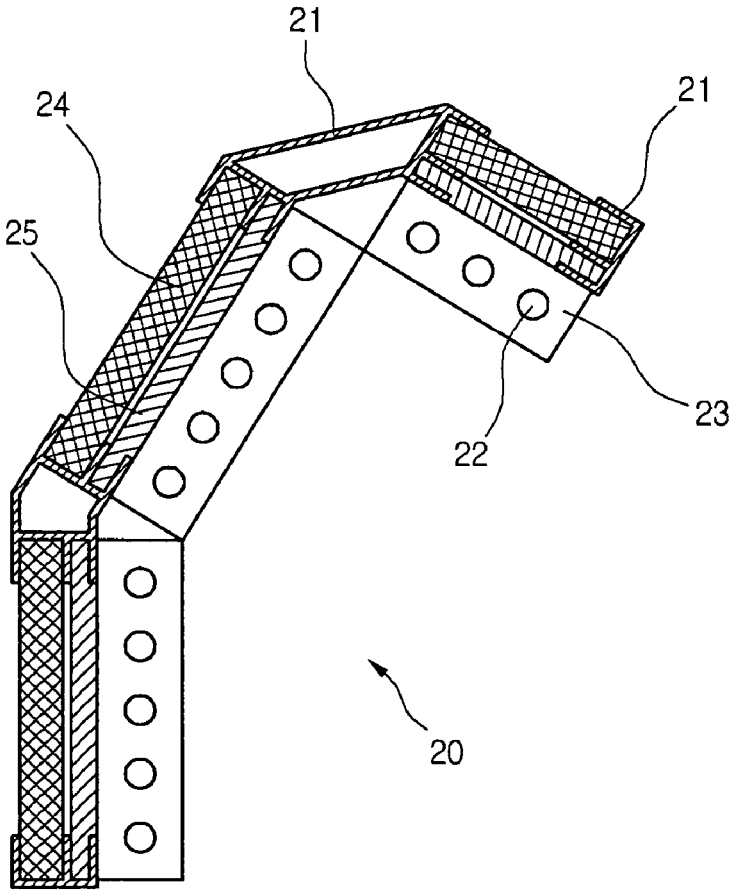
FIG. 8 is a sectional view taken along the II–II' line of FIG. 6.

FIG. 7 is an enlarged view showing B area of FIG. 6, and FIG. 8 is a sectional view taken along II–II' line of FIG. 6.

Referring to FIGS. 7 and 8, the indoor unit includes a heat exchanger 20 having coolant pipes 22 and fins 23, a cartridge 21 combined to the heat exchanger at the front of the heat exchanger, an air-cleaning means 24 formed in a front portion of a space partitioned by the cartridge 21, and a porous material 25 formed in a gap between the air-cleaning means 24 and the heat exchanger 20.

The cartridge 21 gives a place on which the air-cleaning means 24 is seated, and the air-cleaning means 24 is detachably inserted into the cartridge 21. Thus, the air-cleaning means 24 may be exchanged with new one or washed when its air-cleaning ability becomes deteriorated as its use term is expired. In addition, the cartridge 21 may be fixed to the heat exchanger 20 by means of a combination element such as a screw.

The air-cleaning means 24 may have various kinds and shapes of air-cleaning elements such as an air filter or a dust collector. If a plurality of air-cleaning means are piled up, the same number of partitions as the air-cleaning means may be provided so that each air-cleaning means is put into each partition. In addition, the porous material 25 may be fixed to the cartridge 21, or furthermore fixed to the heat exchanger 20 so as to transfer more heat. Of course, in case the porous material 25 is fixed to the heat exchanger 20 or the cartridge 21, the contact efficiency of the porous material may be improved using at least one of the methods already described in the first embodiment.

As mentioned above, the porous material 25 may be fixed to the cartridge due to the following reason. Since the air forcibly blown to the heat exchanger 20 is firstly sufficiently filtered by the air-cleaning means 24, dirt is not accumulated in the pores of the porous material 25, so the pores are not easily clogged.

To describe the operation according to this embodiment, before exchanging heat by the heat exchanger 20, the inhaled air is firstly filtered through the air-cleaning means 24, then exchanges heat through the porous material 25, and then exchanges heat again by the heat exchanger 20. The porous material 25 ensures faster heat exchange since a cool air is transferred from the heat exchanger 20, resultantly improving a heat-exchanging performance of the heat exchanger 20.

In particular, in order to prevent a plurality of the pores formed in the porous material 25 from being filled with foreign matters in the air and acting as a resistance factor against air flow, the air introduced into the porous material 25 is filtered by the air-cleaning means 24 in advance. By such a filtering process, it is possible to prevent the pores from being clogged, thereby extending a life of the porous material 25 or capable of using the porous material 25 semi-permanently.

As another advantage of the present invention, considering the cases that the air-cleaning means 24 is used or not used in the same heat exchanger with the same size and shape, it may be guessed that the air-cleaning means acts as a resistance factor against air flow, thereby decreasing the speed of air flow. Thus, the efficiency of the heat exchanger is deteriorated, so a stronger induction fan or a larger heat exchanger should be used in order to solve such a problem. In the present invention, a porous material is additionally formed between the heat exchanger and the filter in order to improve performance of the heat exchanger in such a case. By forming the porous material, the deteriorated heat-exchanging performance due to the decreased air flow caused by the air-cleaning means may be offset. Thus, even though the air-cleaning means is added, it is possible to obtain the same or increased heat-exchanging performance. In such a reason, there is no need of additional increase of motor output or size of the heat exchanger. Furthermore, though a filter is installed over the entire area of the heat exchanger, the performance of the heat exchanger is not deteriorated.

In addition, since the heat-exchanging performance is increased owing to the porous material 11, the air-cleaning means may be installed over the entire area of the heat exchanger. Thus, it is possible to improve an air-cleaning effect.

Third Embodiment

Figure 9:
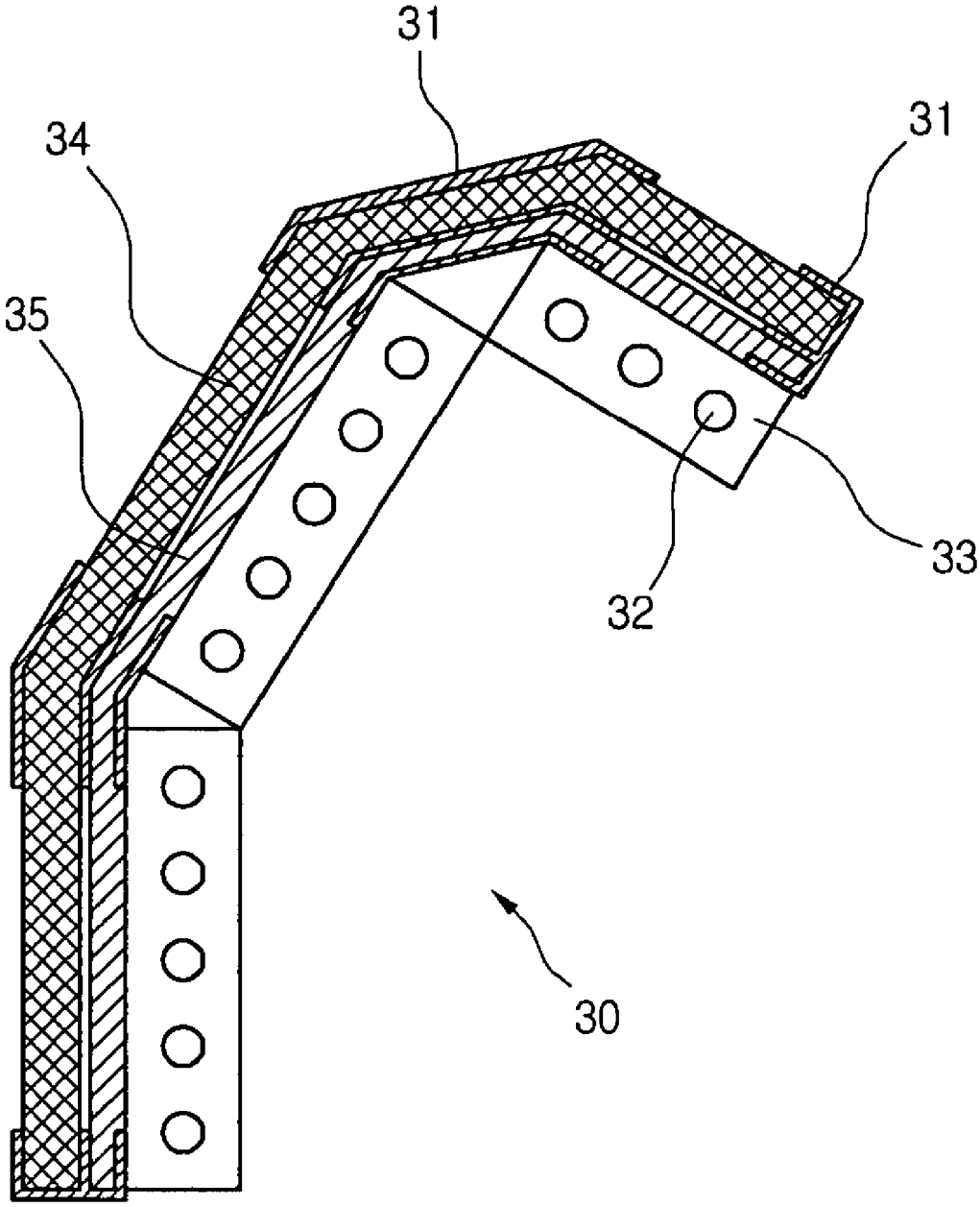
FIG. 9 is a sectional view showing a heat exchanger according to a third embodiment of the present invention.

FIG. 9 shows a heat exchanger according to a third embodiment of the present invention.

Referring to FIG. 9, the heat exchanger of the third embodiment is substantially identical to that of the second embodiment, except that an air-cleaning means 34 and a porous material 35 are formed on the heat exchanger in one body, respectively. This embodiment is particularly suitable for a heat exchanger in which a plurality of horizontal surfaces are formed.

In the second embodiment, the air-cleaning means 24 and the porous material 25 are individually mounted on different even surfaces, bent from each other, respectively. In this case, however, the air-cleaning means 24 and the porous material 25 should be individually assembled and produced for each even surface. Due to the reason, in this embodiment, a single partition is formed along the entire width of the cartridge in a length direction, and then a single body of the air-cleaning means 34 and a single body of the porous material 35 are respectively inserted into a corresponding gap defined by the single partition, thereby further enhancing convenience for assembling and production.

In this embodiment, air may be inhaled through the substantially entire size of a cartridge 31, so it is possible to increase air volume introduced into the heat exchanger, thereby improving the heat-exchanging performance. In addition, since the installation area of the porous material 35 is increased, the heat-exchanging performance of the heat exchanger may be further improved. Unexplained reference numeral 32 is a coolant pipe, and reference numeral 33 is a fin.

By using the present invention, it is possible to install a heat exchanger within a relatively narrow space in compact. Thus, a size of the air controller and/or the heat exchanger may be reduced, and it is helpful to more actively satisfying tastes of consumers who want smaller products.

In addition, since a filter may be installed over the entire area of flow channel in the air controller according to the present invention, an air-cleaning effect may be improved.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An air conditioner having a high-performance heat exchanger, comprising:

a heat exchanger for exchanging heat;

a fan for forcibly blowing air to the heat exchanger;

a porous material formed on one side of the heat exchanger in order to improve a heat-exchanging; and a cartridge for receiving the porous material.

2. The air conditioner according to claim 1, wherein the porous material is contacted with the heat exchanger.

3. The air conditioner according to claim 1, wherein the porous material is contacted with the heat exchanger by using a method selected from the group consisting of pressing, soldering, brazing, and coating of a heat transfer material on a contact surface, alone or in combination.

4. The air conditioner according to claim 1, wherein the porous material is individually formed on each even surface of the heat exchanger.

5. The air conditioner according to claim 1, wherein the porous material has one body over an entire surface of the heat exchanger.

6. The air conditioner according to claim 1, wherein the porous material has pores of several micrometers therein.

7. The air conditioner according to claim 1, wherein the porous material is formed at the front of the heat exchanger on the basis of an air flowing direction.

8. The air conditioner according to claim 1, further comprising an air cleaner formed at the front of the porous material on the basis of an air flowing direction.

9. The air conditioner according to claim 8, further comprising a cartridge fixed to the heat exchanger, the cartridge receiving the air cleaner detachably.

10. The air conditioner according to claim 8, wherein the air cleaner is individually formed on the basis of each even surface of the heat exchanger.

11. The air conditioner according to claim 8, wherein the air cleaner has one body with a shape similar to a sectional shape of the heat exchanger.

12. The air conditioner according to claim 1, wherein a cartridge in which the porous material and/or an air cleaner that cleans air is received is fixed to one side of the heat exchanger.

13. An air conditioner having a high-performance heat exchanger, comprising:

a heat exchanger having coolant pipes and fins for exchanging heat;

a fan for forcibly blowing air to the heat exchanger;

a cartridge fixed to the heat exchanger;

an air cleaner received in the cartridge; and a porous material received in the cartridge between the air cleaner and the heat exchanger in order to improve a heat-exchanging performance.

14. The air conditioner according to claim 13, wherein the cartridge is formed at the front of the heat exchanger on the basis of an air flowing direction.

15. The air conditioner according to claim 13, wherein the air cleaner and/or the porous material has one body with a shape similar to a sectional shape of the heat exchanger.

16. The air conditioner according to claim 13, wherein the air cleaner and/or the porous material is individually formed on the basis of each even surface of the heat exchanger.

17. The air conditioner according to claim 13, wherein the porous material is contacted with the fins.

* * * * *

UNITED STATES PATENT AND TRADEMARK OFFICE

CERTIFICATE OF CORRECTION

PATENT NO. : 7,225,862 B2
APPLICATION NO. : 10/914085
DATED : June 5, 2007
INVENTOR(S) : Chin et al.

It is certified that error appears in the above-identified patent and that said Letters Patent is hereby corrected as shown below:

At column 7, line 33 of the printed patent, "to improve a heat-exchanging;" should be --to improve a heat-exchanging performance--

Signed and Sealed this

Seventeenth Day of June, 2008

JON W. DUDAS
*Director of the United States Patent and Trademark Office*